US008561765B2

(12) United States Patent
Chen et al.

(10) Patent No.: US 8,561,765 B2
(45) Date of Patent: Oct. 22, 2013

(54) DAMPING DEVICE FOR MOVABLE FURNITURE PARTS

(75) Inventors: Ken-Ching Chen, Kaohsiung Hsien (TW); Hsiu-Chiang Liang, Kaohsiung Hsien (TW); Ting-Tsai Huang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 287 days.

(21) Appl. No.: 12/756,404

(22) Filed: Apr. 8, 2010

(65) Prior Publication Data

US 2010/0258986 A1 Oct. 14, 2010

(30) Foreign Application Priority Data

Apr. 10, 2009 (TW) ..... 98112247 A

(51) Int. Cl.
*E05F 3/04* (2006.01)

(52) U.S. Cl.
USPC ..... 188/271; 16/50; 16/54

(58) Field of Classification Search
USPC ..... 267/113, 116, 139; 188/271, 322.12, 188/321.11; 16/50, 54, 82, 84–85, 239, 286
See application file for complete search history.

(56) References Cited

U.S. PATENT DOCUMENTS

| | | | | |
|---|---|---|---|---|
| 6,684,453 | B2 * | 2/2004 | Wang | 16/54 |
| 2006/0220284 | A1 | 10/2006 | Holzapfel | |
| 2008/0098565 | A1 * | 5/2008 | Migli | 16/239 |
| 2008/0109987 | A1 * | 5/2008 | Chen et al. | 16/68 |
| 2008/0168620 | A1 * | 7/2008 | Hammerle | 16/85 |
| 2008/0184627 | A1 * | 8/2008 | Hilger | 49/414 |
| 2009/0083939 | A1 * | 4/2009 | Wu | 16/85 |

* cited by examiner

*Primary Examiner* — Anna Momper
(74) *Attorney, Agent, or Firm* — Rosenberg, Klein & Lee

(57) ABSTRACT

A damping device for movable furniture parts includes a base, a movable member defining a path, a housing movably connected to the path and including a space and an opening which communicates with the space, a damper located in the space and including a cylinder and a piston rod which has one end inserted into the cylinder and the other end of the piston rod extends from the cylinder, a first threaded member connected to the cylinder including, a second threaded member connected to the first threaded member and located corresponding to the opening of the housing, an adjustment member movably connected between the base and the movable member. When rotating the second threaded member, a distance between the housing and the movable member is adjusted. When the adjustment member is adjusted, the relative distance between the base and the movable member is adjusted.

9 Claims, 10 Drawing Sheets

DAMPING DEVICE FOR MOVABLE FURNITURE PARTS

FIELD OF THE INVENTION

The present invention relates to a damping device, and more particularly, to a damping device for movable furniture parts.

BACKGROUND OF THE INVENTION

A conventional damping device for movable furniture parts is disclosed in U.S. Patent Publication No. 2006/0220284 "Damper for movable furniture parts" to Holzapfel, which discloses a housing 2 and a cylinder 3 located in the housing 2. The cylinder 3 includes a retractable piston rod which has one end extends from the cylinder 3 to form a known damping device. A stop 7 is located in the housing 2 and includes multiple teeth 11. A sleeve 8 is connected to the cylinder 3 and has one end thereof extending from the housing 2. A worm wheel 9 is movably connected to the housing 2 and can be operated by using a screwdriver to drive the stop 7 to move in the housing 2, thereby adjusting the position that the stop 7 contacts against the piston rod 5 to control the length that the sleeve 8 protrudes from the housing 2.

The disclosed damper controls the movement of the stop 7 in the housing 2 by operation of the worm wheel 9 so as to control the position of the sleeve 8. However, the movement is linear and along a single axis and this is not satisfied when being used for the movable parts of furniture.

SUMMARY OF THE INVENTION

The present invention intends to provide a damping device for movable furniture parts and the travel distance of the damping device and the contact position to the furniture parts can be adjusted.

The present invention relates to a damping device for movable furniture parts, and the damping distance and the positions that contact the furniture of the damping device can be adjusted.

The damping device comprises a base, a movable member connected to the base and having a support surface which defines a path and a fixing portion corresponding to the path. An adjustment member is connected between the base and the movable member. The adjustment member is movably connected to one of the movable member and the base. A housing is movably connected to the path of the movable member and includes a space. A damper is located in the space of the housing and includes a cylinder. A piston rod has one end inserted into the cylinder and the other end of the piston rod extends from the cylinder and contacts the fixing portion of the movable member. When the adjustment member is adjusted, a distance between the base and the movable member is adjusted.

The present invention provides a damping device which comprises a movable member having a support surface which defines a path and a fixing portion corresponding to the path. A housing is movably connected to the path of the movable member. The housing includes a space and an opening which communicates a portion of the space. A damper is located in the space of the housing and includes a cylinder and a piston rod which has one end inserted into the cylinder. The other end of the piston rod extends from the cylinder and contacts the fixing portion of the movable member. The cylinder of the damper includes a first threaded member and a second threaded member which is movably connected to the first threaded member and located in the opening of the housing. When adjusting the second threaded member, a damping distance between the housing and the movable member is adjusted.

The movable member comprises a pivot portion and the base comprises two lugs and two fixing wings. Each fixing wing has a fixing hole. A pivot member is pivotally connected to the pivot portion of the movable member and the lugs of the base.

The base has a support hole and the movable member has a connection hole which is located corresponding to the support hole of the base. The adjustment member comprises a connection portion which is movably connected to the connection hole of the movable member. A support portion is connected to the support hole of the base. An adjustment portion is located between the connection portion and the support portion. When rotating the adjustment portion, the adjustment member adjusts a distance between the base and the movable member.

The movable member comprises a connection hole which is located at a distance from the fixing portion. The housing comprises two sidewalls extending from two sides thereof. A slide member extends from the sidewalls and comprises two slide portions and a stop wall which is located at an end of the slide portions. A stop is located between the fixing portion and the connection hole so as to contact the stop wall of the slide member.

The base comprises a first slot at a first end thereof and a second slot at a second end thereof which is located in opposite to the first end. A support hole is located between the first and second slots. The support hole includes threads to which the adjustment is threadedly connected. The movable member comprises a first protrusion connected to the first slot of the base and a second protrusion connected to the second slot of the base. A connection hole is located corresponding to the support hole of the base. The adjustment member includes a support portion which is connected to the connection hole of the movable member. An adjustment portion is connected between the connection portion and the support portion, and a part of the adjustment portion is exposed from the movable member so as to be operated to adjust.

The present invention wilt become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
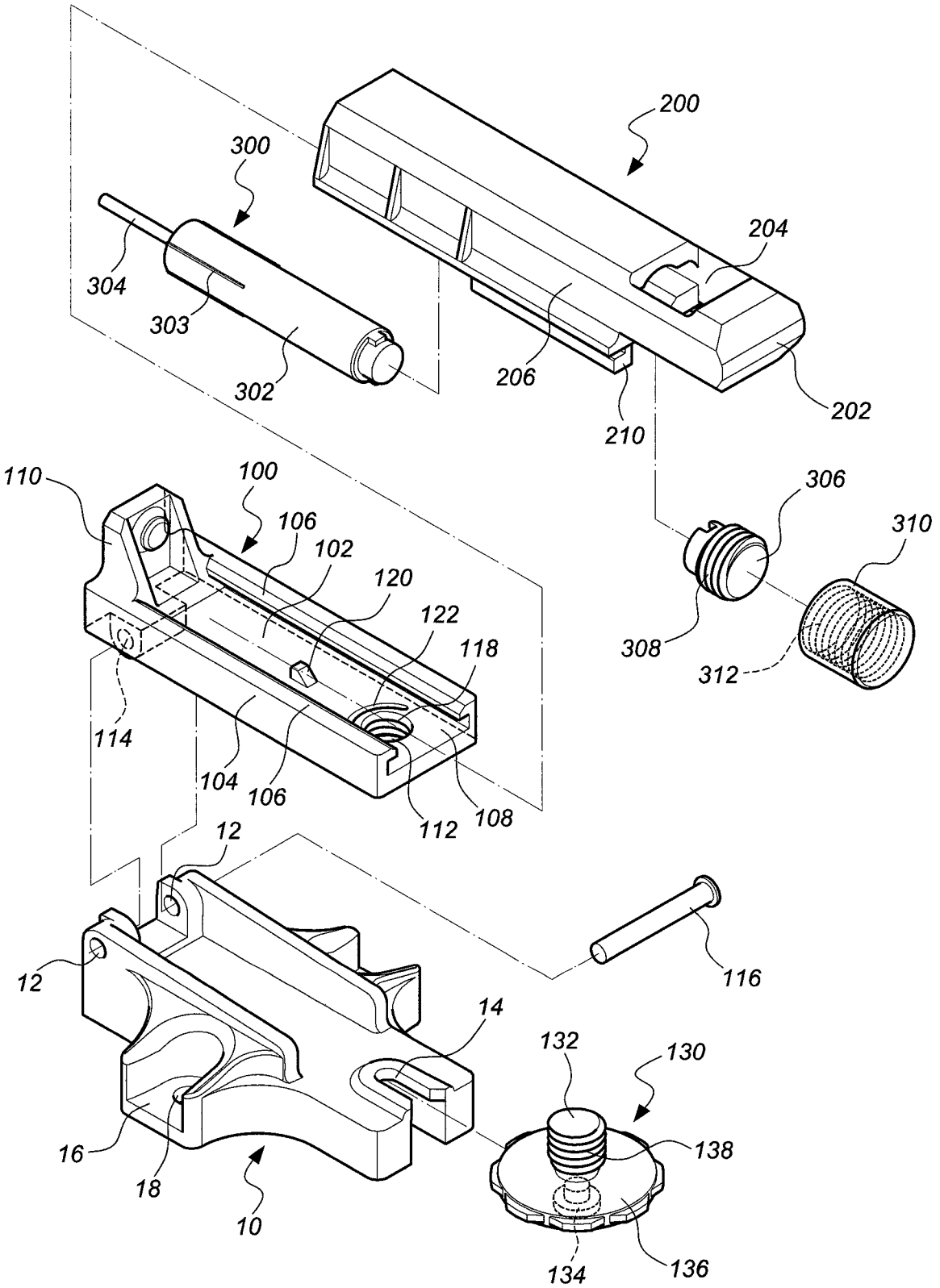
FIG. 1 is an exploded view to show the first embodiment of the present invention.
Figure 2:
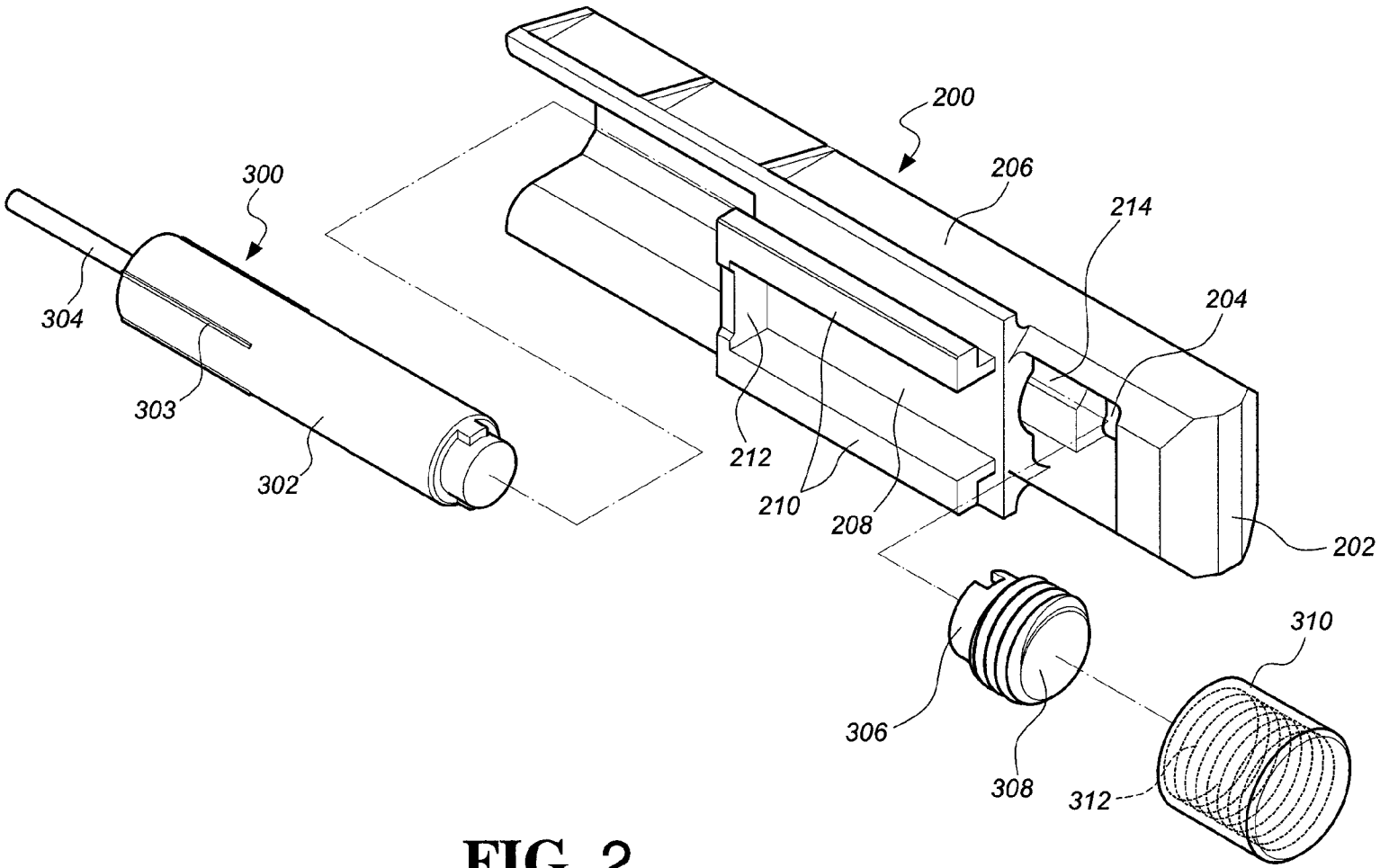
FIG. 2 is an exploded view to show the damper of the first embodiment of the present invention.

FIGS. 1 and 2 show the exploded view of the first embodiment of the damping device of the present invention, which comprises a base 10, a movable member 100, an adjustment member 130, a housing 200, and a damper 300.

The base 10 comprises two lugs 12, a support hole 14 located at a distance from the lugs 12, and two fixing wings 16. Each fixing wing 16 has a fixing hole 18.

The movable member 100 includes a support surface 102, two sidewalls 104 extending upward from two sides of the support surface 102, and two tops 106 extending transversely from two top edges of the two sidewalls 104. The support surface 102, the sidewalls 104 and the tops 106 define a linear path 108. The support surface 102 has a fixing portion 110 which is located at one end of the support surface 102 and located corresponding to the path 108. A connection hole 112 is located at a distance from the fixing portion 110 and located corresponding to the support hole 14 of the base 10. A pivot portion 114 is located adjacent to the fixing portion 110. A pivot member 116 is used to pivotably connect the movable member 100 to the lugs 12 of the base 10. In the embodiment, the connection hole 112 includes threads 118 defined therein. A stop 120 is located on the support surface 102 and between the fixing portion 110 and the connection hole 112. A slot 122 is defined beside the connection hole 112 such that the connection hole 112 can be slightly deformed.

The adjustment member 130 comprises a connection portion 132 which is movably connected to the connection hole 112 of the movable member 100. A support portion 134 is connected to the support hole 14 of the base 10. An adjustment portion 136 is located between the connection portion 132 and the support portion 134. According the embodiment, the connection portion 132 includes threads 138 defined in an outer periphery thereof so as to be threadedly connected to the connection hole 112 of the movable member 100. Therefore, the connection length of the connection portion 132 and the connection hole 112 can be adjusted by rotating the adjustment portion 136 of the adjustment member 130, such that the relative distance between the base 10 and the movable member 100 is adjusted.

The housing 200 comprises a contact end 202 and an opening 204 is defined beside the contact end 202. Two sidewalls 206 extend from two sides of the housing 200. A slide member 208 extends from the sidewalls 206 and comprises two slide portions 210 which are slidably connected to the path 108 of the movable member 100. A stop wall 212 is located at an end of the slide portions 210. By the stop 120, the stop wall 212 of the slide member 208 is in contact with the stop 120 to prevent the housing 200 from disengaging from the movable member 100 when sliding along the movable member 100. The housing 200, the sidewalls 206 and the slide member 208 define a space 214 and the opening 204 is in communication with a portion of the space 214.

Figure 3:
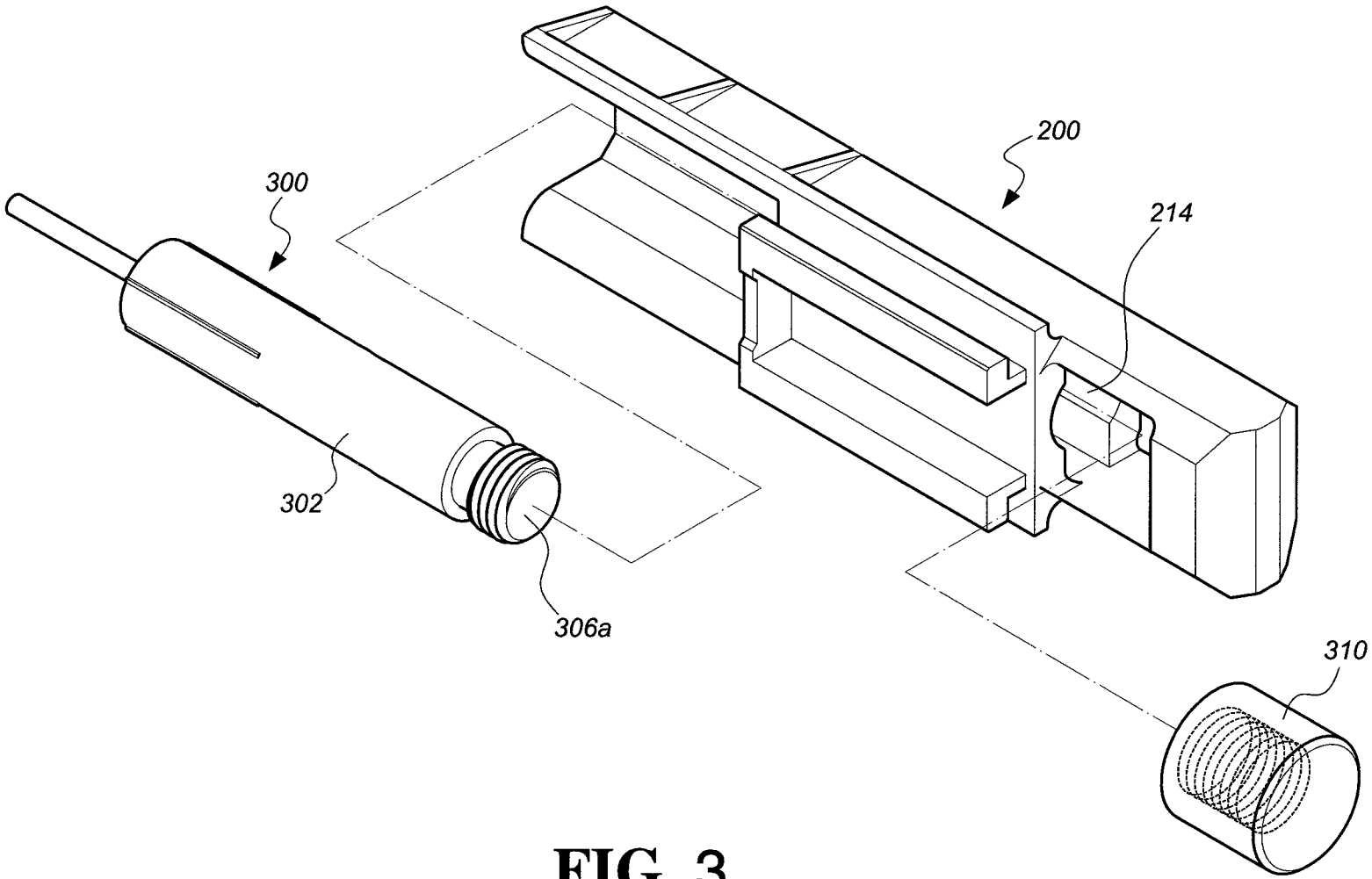
FIG. 3 is an exploded view to show another embodiment of the present invention.

The damper 300 is located in the space 214 of the housing 200 and includes a cylinder 302. Multiple ribs 303 extend outward from the cylinder 302. A piston rod 304 has one end inserted into the cylinder 302, the other end of the piston rod 304 extends from the cylinder 302 and can be pressed to be retracted into the cylinder 302 and contacts the fixing portion 110 of the movable member 100. The cylinder 302 includes a first threaded member 306 connected to the cylinder 302 of the damper 300. A second threaded member 310 is movably connected to the first threaded member 306. In this embodiment, the first threaded member 306 includes threads 308 and the second threaded member 310 includes threads 312 which are threadedly connected to the threads 308 of the first threaded member 306. The second threaded member 310 is located corresponding to the opening 204 of the housing 200 and can be adjusted via the opening 204 so as to change the connection length between the first and second threaded members 306, 310. Alternatively, as shown in FIG. 3, the threaded member **306*a* is directly connected to the end of the cylinder 302 of the damper 300 and extends through the space 214 of the housing 200 so as to be threadedly connected to the second threaded member 310**.

Figure 4:
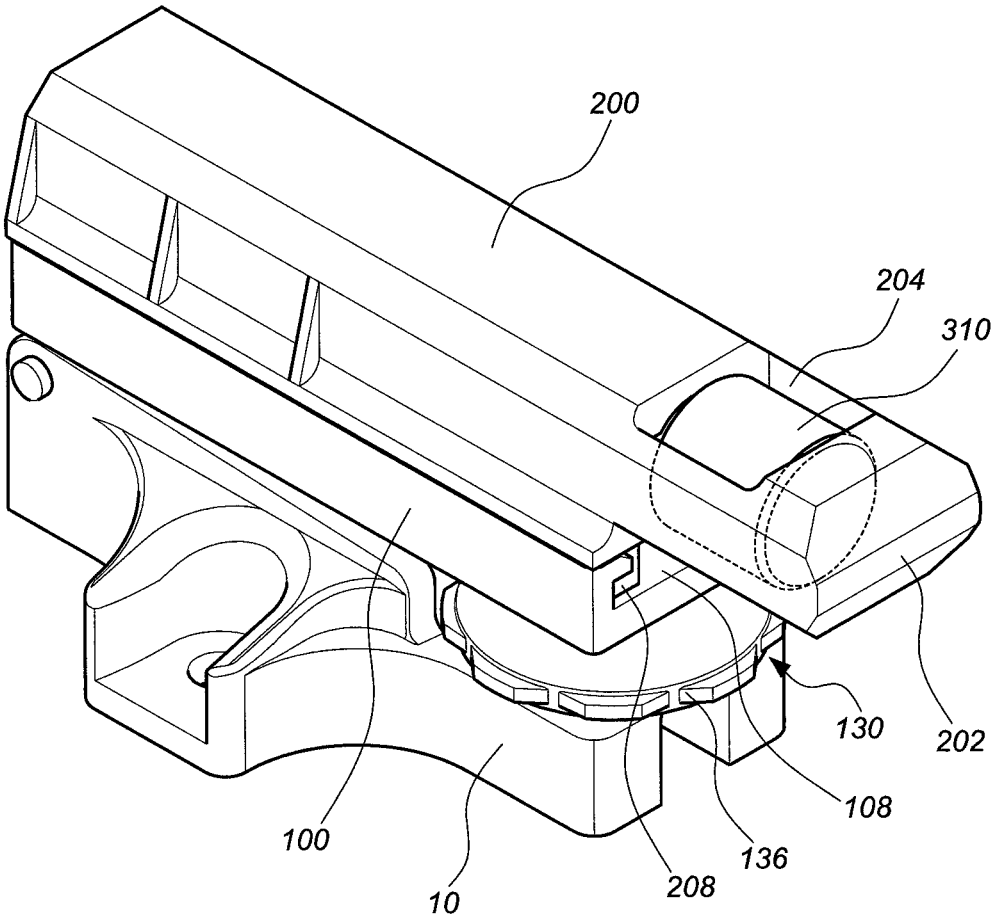
FIG. 4 is a perspective view to show the first embodiment of the present invention.
Figure 5:
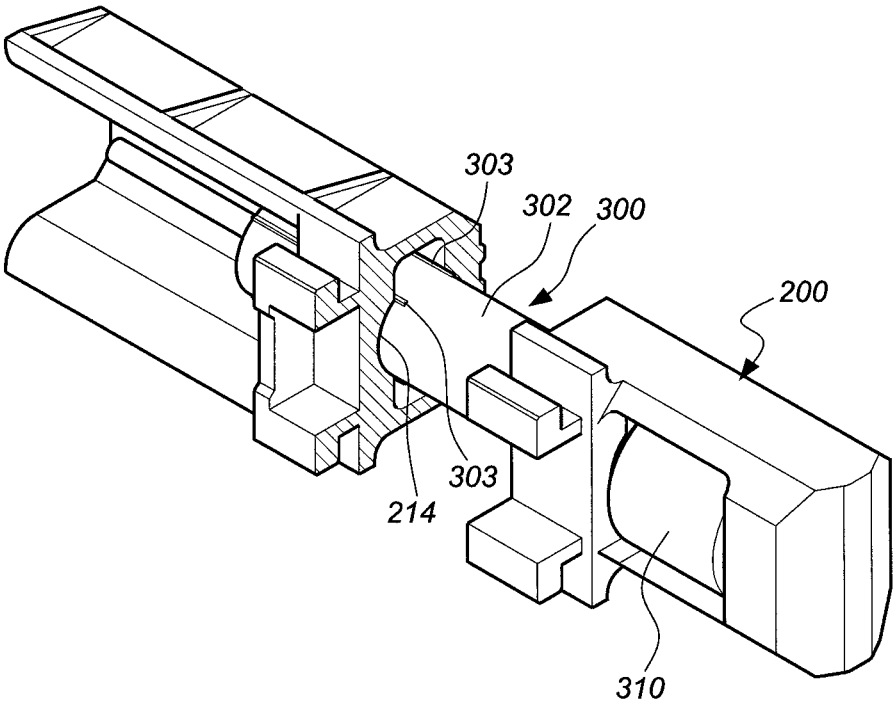
FIG. 5 is a partial cross sectional view of the first embodiment of the present invention.

As shown in FIGS. 4 and 5, when the damper 300 is installed in the space 214 of the housing 200, the opening 204 of the housing 200 allows the second threaded member 310 to be accessible so as to adjust the second threaded member 310. The housing 200 is slidably received in the path 108 of the movable member 100 by the slide member 208. The cylinder 302 of the damper 300 is secured in the space 214 of the housing 200 and does not rotate by engaging the ribs 303 on the cylinder 302 with the inside of the space 214 of the housing 200, so that only the second threaded member 310 is rotated.

Figure 6:
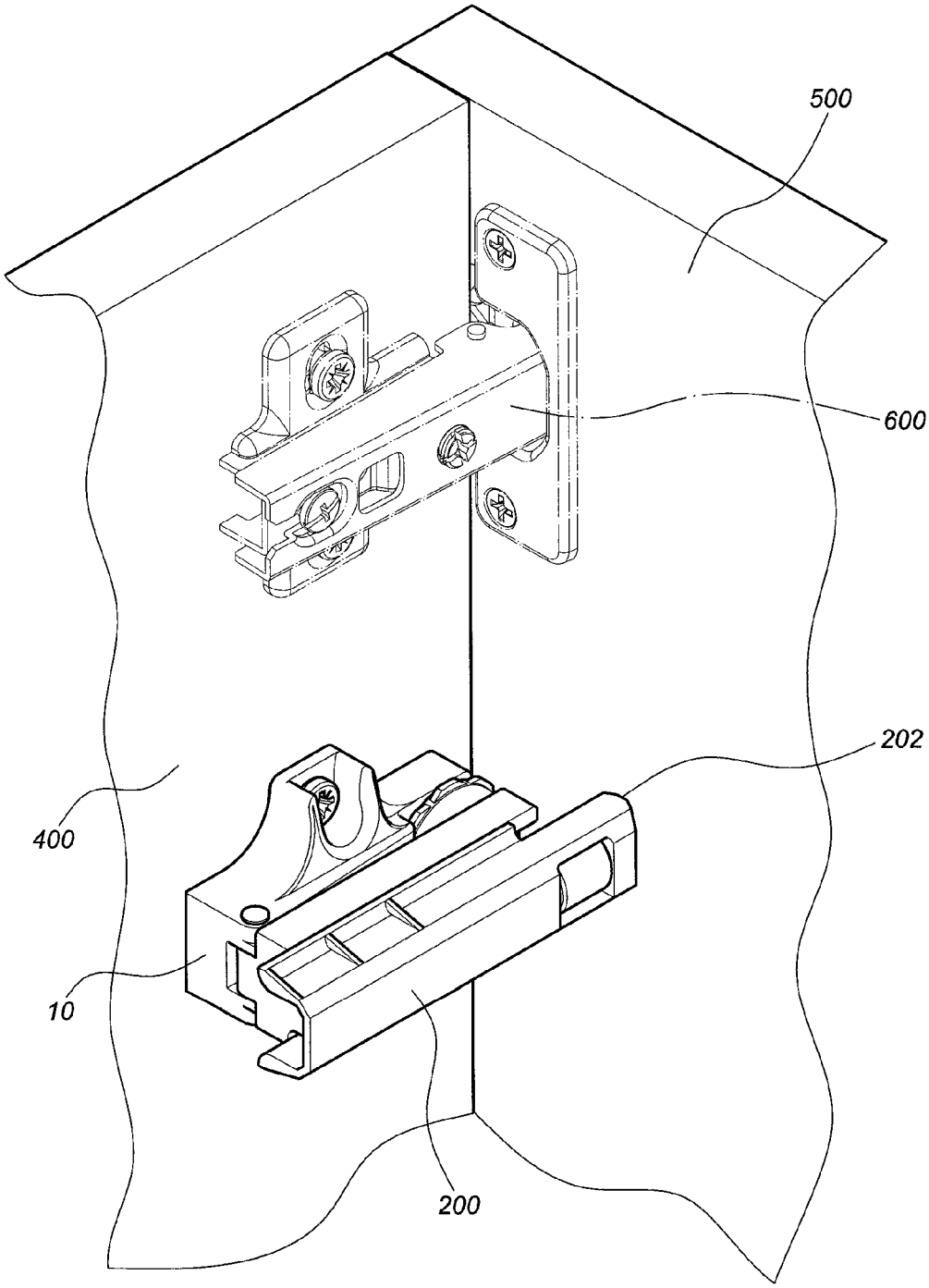
FIG. 6 is a perspective view to show that the first embodiment of the present invention is installed to a furniture part.

FIG. 6 shows the embodiment of the damping device installed to furniture parts which includes a fixed member 400 such as a cabinet, a door frame, a window frame or the like, and a movable member 500 such as a door, a window, a drawer or the like. The movable member 500 is movably connected to the fixed member 400. The dotted lines in the drawing show a hinge 600, by which the fixed member 400 is connected to the movable member 500. The movable member 500 is closed relative to the fixed member 400 by itself. When in use, the damping device is connected to the fixed member 400 by the base 10 so that the contact end 202 of the housing 200 is located corresponding to the movable member 500. When the movable member 500 is moved relative to the fixed member 400 and contacts the contact end 202 of the housing 200, the movable member 500 is damped by the movement of the housing 200 to reduce the speed of movement relative to the fixed member 400.

Figure 7:
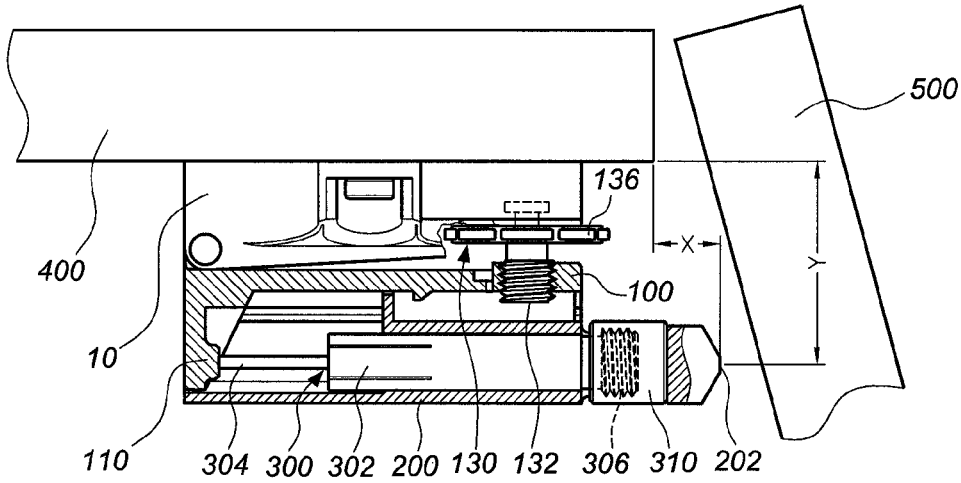
FIG. 7 is cross sectional view to show that the first embodiment of the present invention is installed to a furniture part.

FIG. 7 shows that the damping device is fixedly connected to the fixed member 400 by the base 10 so that the contact end 202 of the housing 200 of the damping device is located corresponding to the movable member 500. The horizontal distance and the vertical distance from the contact end 202 of the housing 200 to the movable member 500 are respectively X and Y. In this status, the piston rod 304 of the damper 300 contacts the fixing portion 110 of the movable member 100, and the cylinder 302 of the damper 300 is pivoted by the connection of the first and second threaded members 306, 310, and by the adjustment member 130 connected between the base 10 and the movable member 100.

Figure 8:
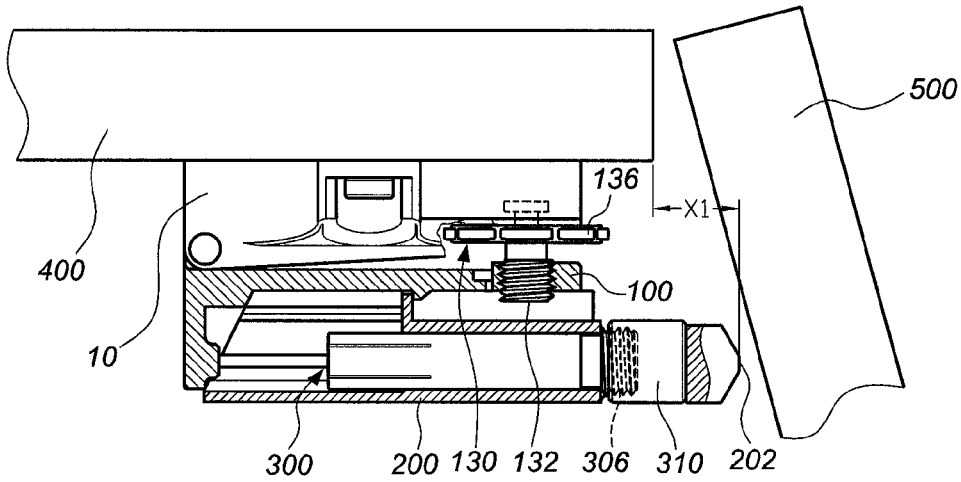
FIG. 8 is cross sectional view to show that the first embodiment of the present invention is installed to a furniture part and a distance "X1" is adjusted.

FIG. 8 shows that the damping device is shifted by rotating the second threaded member 310 such that the horizontal distance of the contact end 202 of the housing 200 relative to the movable member 100 or the fixed member 400 can be adjusted, as shown by X1 in the drawing. Therefore, the damping distance of the movable member 500 relative to the fixed member 400 can be adjusted. The damping distance of the damping device of the present invention can be adjusted to be optimum according to the specifications of the fixed member 400 and the movable member 500.

Figure 9:
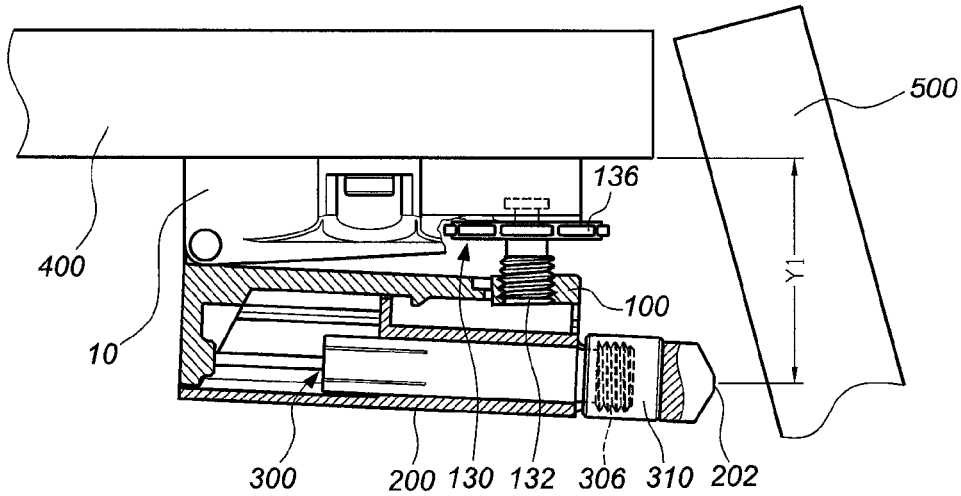
FIG. 9 is cross sectional view to show that the first embodiment of the present invention is installed to a furniture part and a distance "Y1" is adjusted.

FIG. 9 shows that damping device adjusts the threaded length of the connection portion 132 by rotating the adjustment portion 136 of the adjustment member 130, such that the relative distance between the base 10 and the movable member 100 can be adjusted. The feature is used to adjust the angle and the contact position, such as the Y1 in the drawing, of the movable member 500 to the contact end 202 of the housing 200. The distance of the torque of the pivotal force of the movable member 500 relative to the housing 200 is adjusted. Therefore, by adjusting the force that drives the movable member 500 to enter the damping travel relative to the fixed member 400, the damping feature of the damping device of the present invention can be adjusted to be optimum according to the specifications of the fixed member 400 and the movable member 500.

Figure 10:
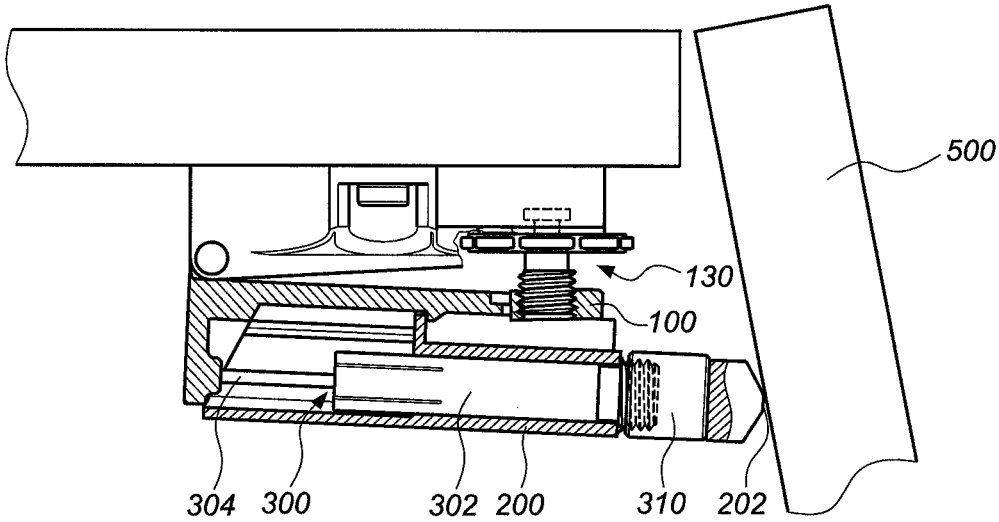
FIG. 10 is cross sectional view to show that the first embodiment of the present invention is installed to a furniture part and the extension of the piston rod is adjusted.
Figure 11:
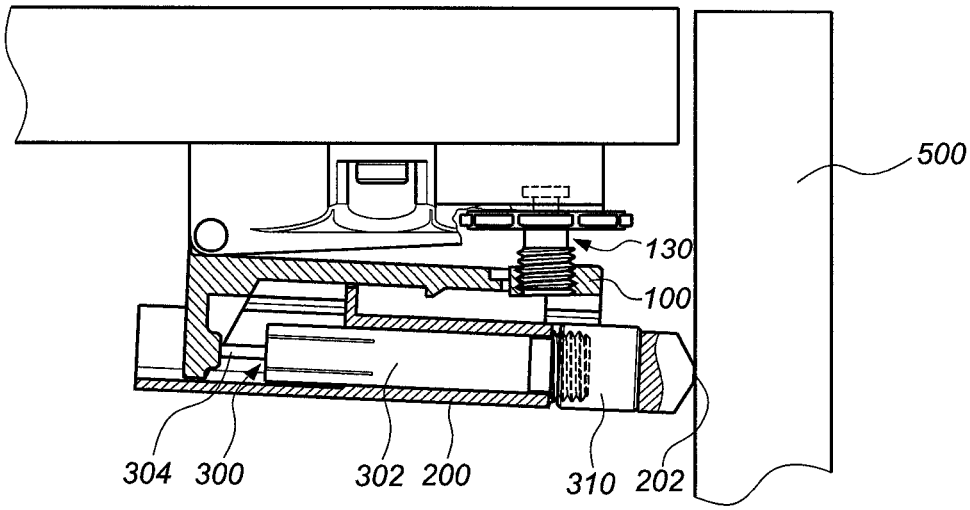
FIG. 11 is cross sectional view to show that the first embodiment of the present invention is installed to a furniture part and the extension of the piston rod is adjusted.

FIGS. 10 and 11 show that the contact end 202 of the housing 200 contacts the movable member 500. In this embodiment, by rotating the adjustment member 130 or the second threaded member 310, the timing of contact and the position of contact of the movable member 500 to the housing 200 can be individually or simultaneously adjusted. After the movable member 500 contacts the contact end 202 of the housing 200, the damping travel begins. By gently inserting the piston rod 304 of the damper 300 into the cylinder 302, the movable member 500 is damped by the movement of the piston rod 304.

Figure 12:
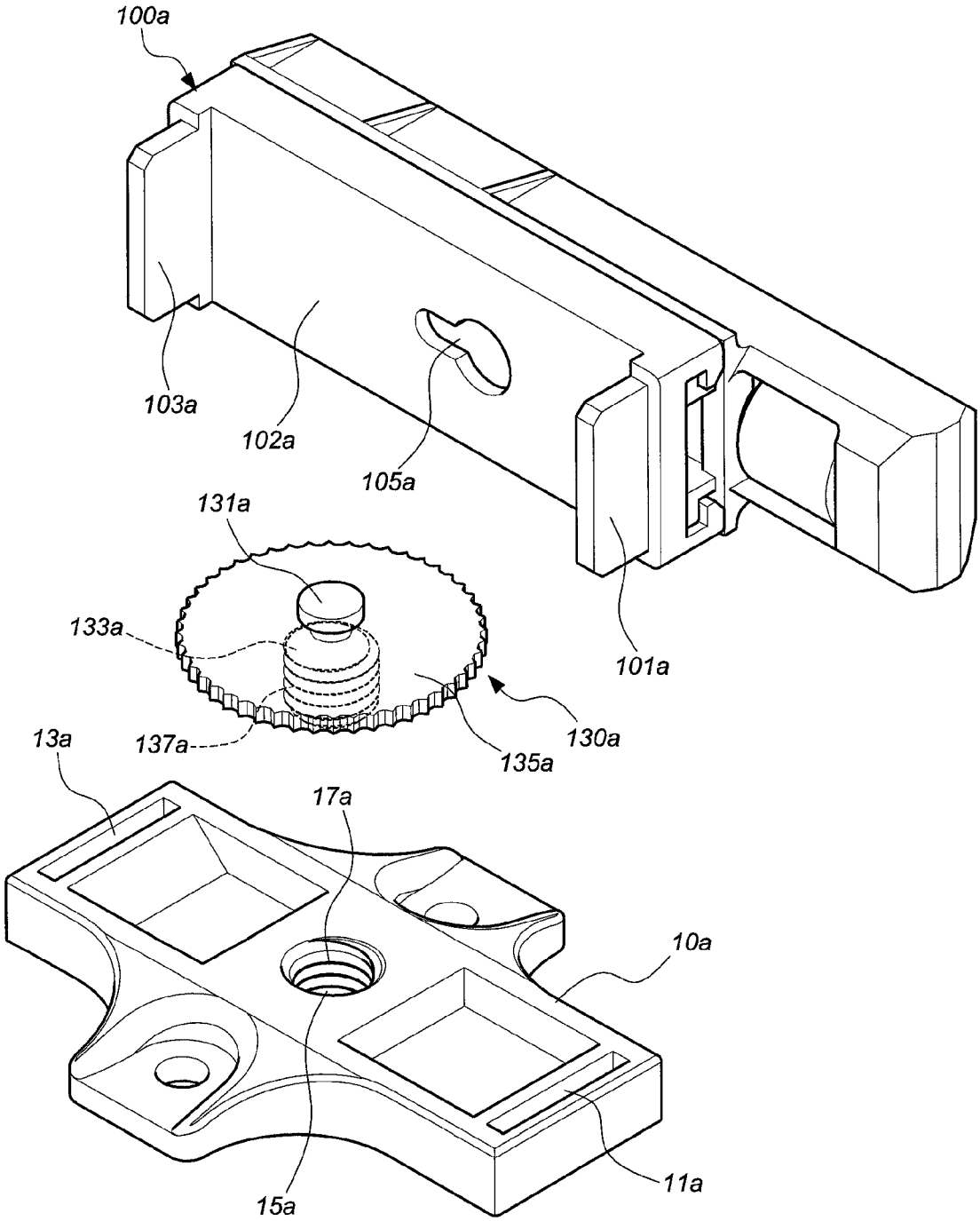
FIG. 12 is an exploded view to show the second embodiment of the present invention.
Figure 13:
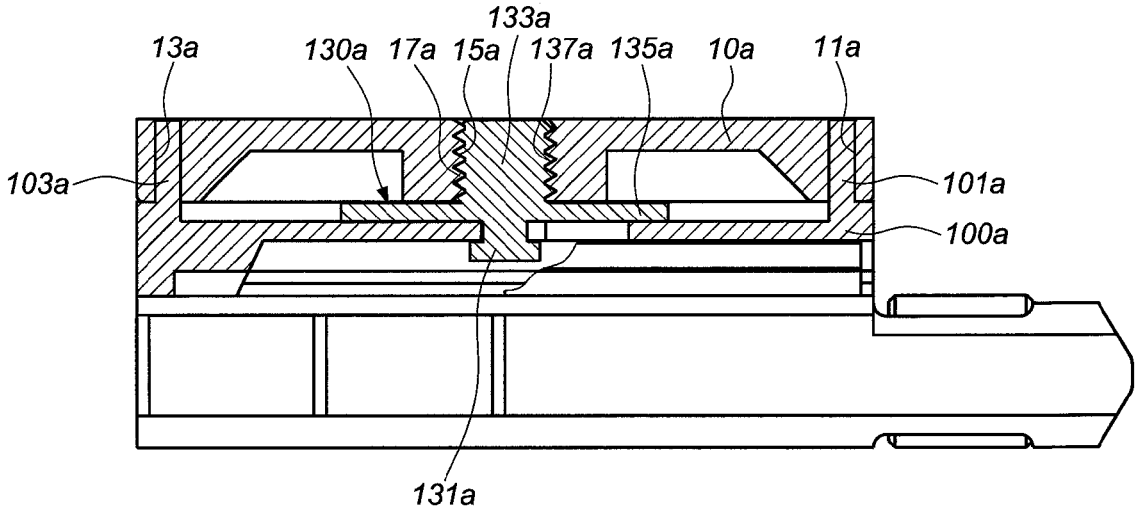
FIG. 13 is a cross sectional view of the second embodiment of the present invention.

FIGS. 12 and 13 show the exploded view and cross sectional view of the second embodiment of the damping device of the present invention. The second embodiment mainly employs the arrangement in the first embodiment, and comprises a base 10*a*, a movable member 100*a*, and an adjustment member 130*a*.

The base 10*a* comprises a first slot 11*a* at a first end thereof and a second slot 13*a* at a second end thereof which is located in opposite to the first end. A support hole 15*a* is located between the first and second slots 11*a*, 13*a*. The support hole 15*a* includes threads 17*a*.

The movable member 100*a* comprises support surface 102*a* which has a first protrusion 101*a* connected to the first slot 11*a* of the base 10*a* and is movable linearly. A second protrusion 103*a* is connected to the second slot 13*a* of the base 10*a* and is movable linearly. A connection hole 105*a* is located corresponding to the support hole 15*a* of the base 10*a*.

The adjustment member 130*a* comprises a connection portion 131*a* which is connected to the connection hole 105*a* of the movable member 100*a*. A support portion 133*a* is movably connected to the support hole 15*a* of the base 10. An adjustment portion 135*a* is located between the connection portion 131*a* and the support portion 133*a*. A part of the adjustment portion 135*a* is exposed from the movable member 100*a* so as to be operated. In this embodiment, the support portion 133*a* includes threads 137*a* which are threadedly connected to the threads 17*a* in the support hole 15*a* of the base 10*a*.

Figure 14:
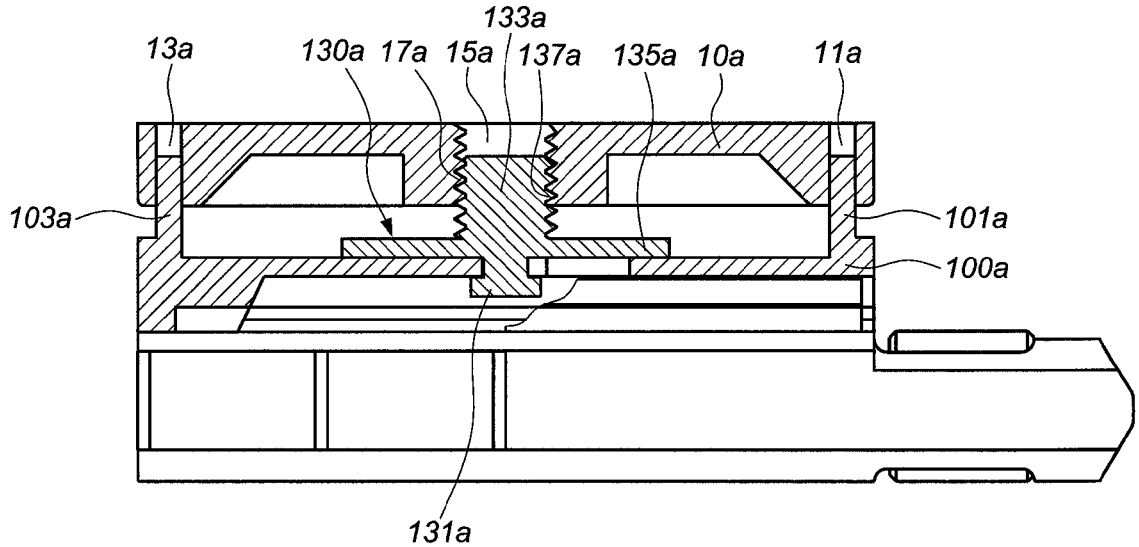
FIG. 14 shows the adjustment of the second embodiment of the present invention.

As shown in FIG. 14, the threaded length between the support portion 133*a* and the support hole 15*a* can be adjusted by rotating the adjustment portion 135*a* of the adjustment member 130*a*, such that the relative distance between the base 10*a* and the movable member 100*a* can be adjusted.

While we have shown and described the embodiment in accordance with the present invention, it should be clear to those skilled in the art that further embodiments may be made without departing from the scope of the present invention.

What is claimed is:

1. A damping device for movable furniture parts, the furniture includes a fixed component and a movable component which is movably connected to the fixed component, the damping device comprising:

a base fixedly connected to the fixed component and spaced from a hinge connecting the fixed component to the movable component, the base having a support hole formed therein;

a movable member connected to the base adjacent one end of the movable member, the movable member having a support surface which defines a path, a fixing portion corresponding to the path and disposed adjacent the one end of the movable member, and a connection hole adjacent an opposing end of the movable member;

an adjustment member rotatably connected between the base and the movable member, the adjustment member being threadedly connected to one of the connection hole of the movable member and the support hole of the base and rotatably coupled to the other one of the support hole and the connection hole, the adjustment member having an adjustment portion extending radially beyond an outer surface of the movable member, the movable member being thereby angularly displaceable relative to the base responsive to rotation of the adjustment portion of the adjustment member;

a housing movably connected to the movable member, the housing including a space and an opening which communicates with the space, the housing terminating at a free end that contacts the movable component;

a damper located in the space of the housing and including a cylinder and a piston rod which has one end inserted into the cylinder, an opposing end of the piston rod extending from the cylinder and contacting the fixing portion, the cylinder including a first threaded member on an end thereof; and a second threaded member connected to the first threaded member on one end thereof and contacting an inner wall of the housing on an opposing end, the second threaded member being located in correspondence with the opening of the housing;

wherein a longitudinal extension distance of the housing relative to the movable member is adjusted responsive to a user's rotation of the second threaded member through the opening in the housing and a transverse distance of the free end of the housing relative to the base is adjusted responsive to a user's rotation of the adjustment portion of the adjustment member.

2. The damping device as claimed in claim 1, wherein the movable member is pivotally connected to the base by a pivot portion formed on the movable member coupled between two lugs formed on the base and a pivot member pivotally connecting the pivot portion of the movable member and the lugs of the base.

3. The damping device as claimed in claim 1, wherein the adjustment member includes a support portion rotatably disposed in the support hole of the base and a connection portion threadedly connected to the connection hole of the movable member.

4. The damping device as claimed in claim 1, wherein the housing comprises two sidewalls extending from two sides thereof, a slide member extends from the sidewalls and comprises two slide portions and a stop wall which is located at an end of the slide portions, a stop is located between the fixing portion and the connection hole so as to contact the stop wall of the slide member.

5. A damping device comprising:

a base;

a movable member displaceably connected to the base and having a support surface which defines a path and a fixing portion corresponding to the path;

a housing movably connected to the movable member, the housing including an internal space and an opening in communication with the internal space formed through a wall of the housing, the housing terminating at a free end that contacts a movable component of a piece of furniture;

a damper located in the internal space of the housing and including a cylinder and a piston rod which has one end inserted into the cylinder, an opposing end of the piston rod extending from the cylinder and contacting the fixing portion of the movable member, the cylinder including a first threaded member on an end thereof;

a second threaded member connected to the first threaded member on one end thereof and contacting an inner wall of the housing on an opposing end, the second threaded member being located in correspondence with the opening in the housing; and an adjustment member rotatably connected between the base and the movable member, the adjustment member being threadedly connected to one of a connection hole of the movable member and a support hole of the base and rotatably coupled to the other one of the support hole and the connection hole, the adjustment member having an adjustment portion extending radially beyond an outer surface of the movable member;

wherein a longitudinal extension distance of the housing relative to the movable member is adjusted responsive to a user's rotation of the second threaded member through the opening in the housing and a transverse distance of the free end of the housing relative to the base is adjusted responsive to a user's rotation of the adjustment portion of the adjustment member.

6. The damping device as claimed in claim 5, wherein the movable member comprises a pivot portion and the base comprises two lugs and two fixing wings, each fixing wing has a fixing hole, a pivot member is pivotally connected to the pivot portion of the movable member and the lugs of the base.

7. The damping device as claimed in claim 6, wherein the support hole is disposed in correspondence to the connection hole, the adjustment member comprises a connection portion which is threadedly connected to the connection hole of the movable member and a support portion rotatably connected to the support hole of the base.

8. The damping device as claimed in claim 5, wherein the housing comprises two sidewalls extending from two sides thereof, a slide member extends from the sidewalls and comprises two slide portions and a stop wall which is located at an end of the slide portions, a stop is located between the fixing portion and the connection hole so as to contact the stop wall of the slide member.

9. The damping device as claimed in claim 5, wherein the base comprises a first slot at a first end thereof and a second slot located a second end thereof which is located in opposite to the first end, the support hole is located between the first and second slots, the support hole includes threads to which the adjustment is threadedly connected, the movable member comprises a first protrusion connected to the first slot of the base and a second protrusion connected to the second slot of the base.

* * * * *